US005293658A

United States Patent [19]

Hüther

[11] Patent Number: 5,293,658

[45] Date of Patent: Mar. 15, 1994

[54] SEPARABLE BRIDGE

[75] Inventor: Herbert Hüther, Wangen, Fed. Rep. of Germany

[73] Assignee: Dornier GmbH, Fed. Rep. of Germany

[21] Appl. No.: 976,512

[22] Filed: Nov. 13, 1992

[30] Foreign Application Priority Data

Nov. 14, 1991 [DE] Fed. Rep. of Germany ..... 4137500

[51] Int. Cl.[5] ..... E01D 15/12

[52] U.S. Cl. ..... 14/2.4; 14/5

[58] Field of Search ..... 14/2.4, 2.5, 2.6, 5, 14/9, 10, 11; 52/641, 645

[56] References Cited

U.S. PATENT DOCUMENTS 4,745,724 5/1988 Reetz ..... 52/645 X
4,972,538 11/1990 Parramore ..... 14/2.6 X
5,042,101 8/1991 Huether ..... 14/5 X
5,107,561 4/1992 Hüther ..... 14/2.4

*Primary Examiner*—Ramon S. Britts
*Assistant Examiner*—James A. Lisehora
*Attorney, Agent, or Firm*—Evenson, McKeown, Edwards & Lenahan

[57] ABSTRACT

A separable bridge, particularly useful for military purposes, having bridge modules which can be coupled together and whose roadway elements, diagonal elements and lower chords form a vertically adjustable framework. The lower chords of the bridge modules are shorter than the roadway element of that bridge module, and the diagonal elements are fastened to ends of the lower chords. The roadway elements have a plurality of fastening points for the diagonal elements and the lower chords. These fastening points are located at different distances from an end of the roadway element. The roadway element, the lower chords and the diagonal elements have constant lengths.

9 Claims, 2 Drawing Sheets

SEPARABLE BRIDGE

BACKGROUND AND SUMMARY OF THE INVENTION

The present invention relates to a separable bridge, particularly useful for military purposes, and having one or more bridge modules which can be coupled together to form the bridge, with each bridge module having at least one roadway element, lower chord and diagonal element, with the height of the framework formed by the roadway elements, the lower chords and the diagonal elements being adjustable.

A separable bridge is known from the German Patent Document DE-AS 12 07 948 and comprises several bridge elements that can be coupled. The bridge elements each contain a bridge floor (or roadway) plate, lower chords and struts. The bridge elements are designed either as center elements with a horizontally extending roadway or as ramp elements with a sloped roadway. The ramp elements cannot be used as center elements so that, when the bridge is transported, a relatively large number of parts must be carried along.

A separable bridge of the same type is known from the German Patent Document DE-OS 38 14 502 and comprises several bridge elements that can be coupled. The bridge elements represent a framework of bridge floor (roadway) plates, lower chords and diagonal struts Since the lower chords and the diagonal struts can be telescoped or can be fastened at specific coupling points, the height of the structural elements can be adjusted.

It is an object of the invention to provide a bridge of this type in such a manner that is lighter and simpler in its construction.

This and other objects are achieved by the present invention which provides a separable bridge comprising a plurality of bridge modules coupled together to form the bridge, each bridge module having at least one roadway element, lower chords and diagonal elements, with the height of a framework of each bridge module formed by the roadway elements, the lower chords and the diagonal elements being adjustable. The lower chords of a bridge module are shorter than the roadway elements of that bridge module, and the diagonal elements are fastened to ends of the lower chords. The roadway elements have a plurality of fastening points for the diagonal elements and the lower chords, these fastening points being located at different distances from an end of the roadway element. The roadway element, the lower chords and the diagonal elements have constant lengths.

The bridge according to the invention retains the advantages of the bridge described in the German Patent Document DE-OS 38 14 502. These advantages include exposure of a small area to wind, as well as to bombardment. Also, a high variability is provided. This means that either one very long or several short bridges can be built simultaneously by one vehicle. No front end support is required up to approximately 45 meters. The bridge has a low weight and a low transport volume. Additionally, the bridge construction allows a good view of the bridge for a tank driver when driving onto the bridge. When one bridge section fails, only the overall length is reduced and the overall system will not fail. The bridge structure is an open structure, so that the view to coupling points and other critical points is unimpaired. Also, assembly behind the front line is not necessary because all elements are exchangeable. There is no tactical limitation (i.e., decision concerning the length of the bridge is made at the destination).

In addition to these advantages, the bridge according to the present invention is lighter and simpler in its construction than the known bridge since telescoping parts are no longer required (which must have a double-walled design). The height and the slope of the bridge modules are freely selectable within a wide range. The linking of the diagonal elements to the ends of the lower chords allows a lighter construction of the lower chords than in the case of a linking in the center. The very short diagonal elements (shorter than half the lower chords) of the present invention again reduces the overall weight. As a result of the shortness of the lower chords with respect to the roadway, a larger height of the bridge (an arch) is obtained which automatically has a larger length.

Other objects, advantages and novel features of the present invention will become apparent from the following detailed description of the invention when considered in conjunction with the accompanying drawings.

DETAILED DESCRIPTION OF THE DRAWINGS

Figure 1A:
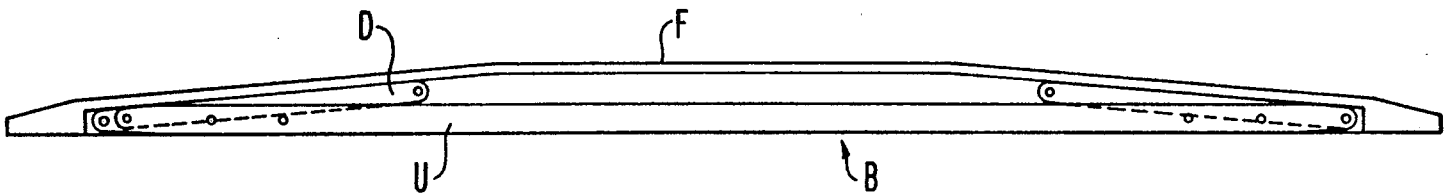
FIGS. 1*a*, 1*b*, and 1*c* are views of a bridge module according to an embodiment of the present invention.
Figure 1B:
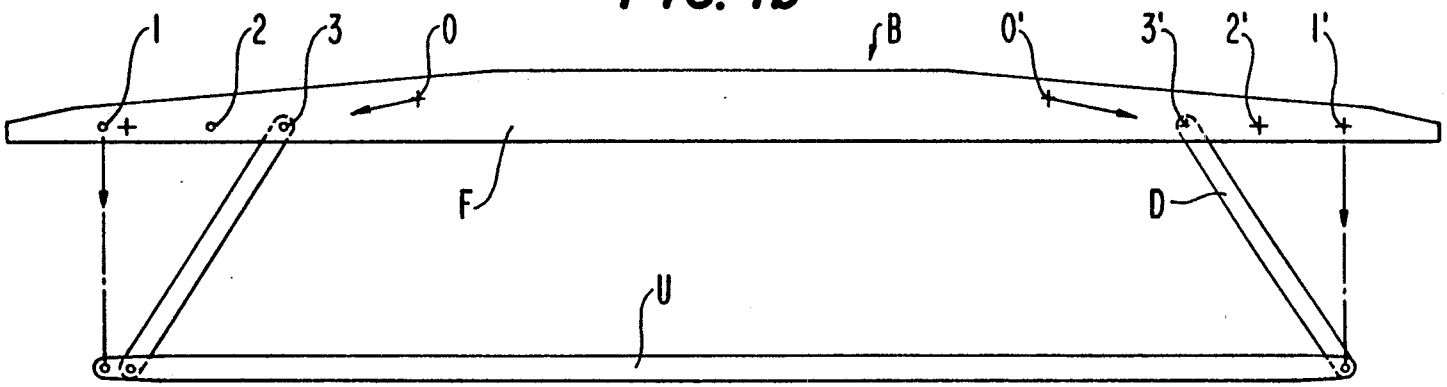
Figure 1C:
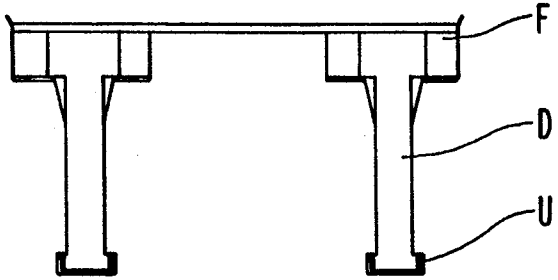

FIG. 1*a* illustrates a bridge module B in a transport condition (or as a short bridge), while FIGS. 1*b* and 1*c* show side and end views of the bridge module B in an unfolded condition. In this embodiment, the bridge module B comprises a roadway element F, two lower chords U and four diagonal elements (or struts) D. For a space-saving transport, the diagonal elements D and the lower chord U may be lowered into the roadway element F as seen in FIG. 1*a*. As seen in FIG. 1*c*, the roadway element F here has a U-shaped cross-section which leaves room in the center for a front end support or a front end point or a laying girder. It is easy to see that the lower chord U is shorter than the roadway element F, whereby the lower chord U can be received completely in the roadway element F. The relatively short diagonal elements D may also be received completely in the roadway element F in the transport condition or in the short bridge configuration. Furthermore, the different fastening possibilities for the diagonal elements D and the lower chord U in the roadway element F are visible. In this construction, different fastening points 1, 2, 3, 0 for the diagonal elements D and for the lower chord U respectively are also shown at each end of the roadway element F. In the illustrated embodiment, fastening points 1, 2, 3, 1', 2', and 3' are provided for the lower chords U and the fastening points 1, 3, 1' and 3' are also provided for the diagonal struts D.

If other heights or sloping possibilities of the bridge elements B are desirable, the fastening points will be situated at different locations. In this case, the upper end of the diagonal element D is guided here (for example, in rails) in the roadway element F. In the folded condition, the upper end is situated at point 0 (0'). During the lifting of F, U and D will unfold automatically. Fastening point 1 is separated from fastening point 0 by the length of one diagonal element D.

The fastening of the lower chords U and the diagonal elements D at the fastening points is accomplished by any of a number of conventional methods of fastening.

Figure 2A:
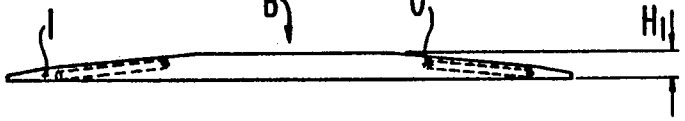
FIGS. 2*a*, 2*b*, and 2*c* are views of three possible bridge constructions using an embodiment of the present invention.
Figure 2B:
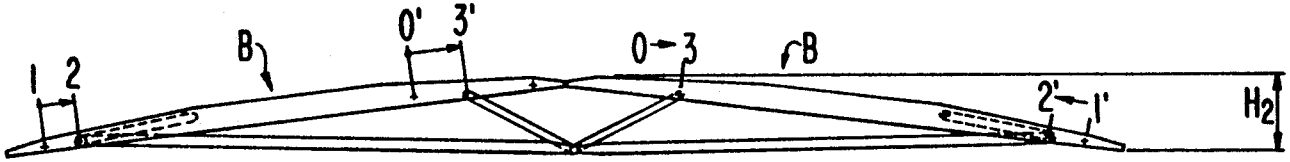
Figure 2C:
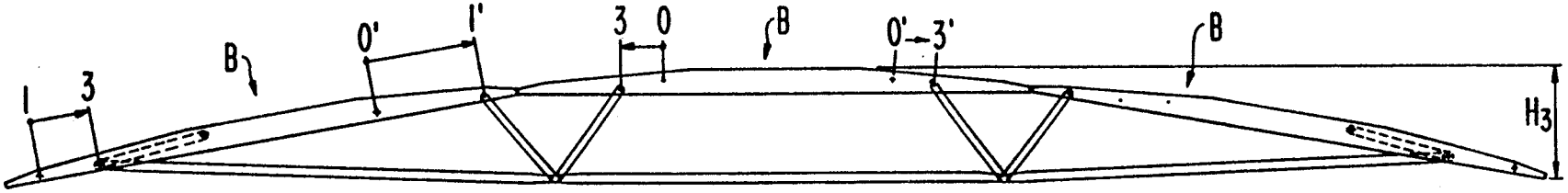

FIGS. 2*a*, 2*b*, and 2*c* shows three embodiments of bridges according to the invention which are each assembled of 1, 2 or 3 of the bridge modules B shown in FIG. 1. FIG. 2*a*, shows a short bridge whose length corresponds to a bridge module B and whose height H1 corresponds to the height of the roadway element F. As shown in FIG. 1*a*, the diagonal elements D and the lower chords U are sunk in the roadway element F.

FIG. 2*b* illustrates a bridge of a medium-sized span which is formed from two bridge modules B that are coupled together. The lower chords U are no longer arranged at the exterior fastening points 1 but at fastening points 2 and 2' which are situated farther toward the inside. The other end of the lower chords U is in each case connected with the lower chord U of the other bridge module. The upper ends of the central diagonal elements D shift during the unfolding from points 0 or 0' to points 3 or 3'. In comparison to the shorter bridge, this bridge has a larger height H2 and therefore a bearing capacity which is adapted to the larger length.

FIG. 2*c* shows a long bridge with a correspondingly larger height H3 which is composed of three bridge modules B. In the left bridge element B, the lower chord U is pivotally linked to fastening point 3 which is farther removed from the end than fastening point 2. The left diagonal element D is disposed inside the roadway F without any function. The right diagonal element of the left bridge module B is pivotally linked in the fastening point 1' of the roadway element F. The same applies in a mirror-inverted manner to the right bridge module B. The center bridge module B is coupled between the two above-mentioned bridge modules B. The lower chords U of the three bridge modules are directly connected with one another; so are the roadway elements F so that the desired higher arch is obtained. The diagonal elements D of the center bridge module are fastened in the fastening points 3, 3' of the roadway element F of the center bridge module B.

Bridges comprising more than three of such elements B are also conceivable with the present invention.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A separable bridge comprising:

a plurality of bridge modules coupled together to form said bridge, each bridge module having a roadway element, lower chords and diagonal elements, with the height of a framework of each bridge module in a transport condition being formed by the roadway element, the lower chords and the diagonal elements being adjustable;

wherein the lower chords of a bridge module are shorter than the roadway element of that bridge module, and first ends of the diagonal elements are fastened to ends of the lower chords;

wherein the roadway element has a plurality of fastening points selectively fastenable to either second ends of the diagonal elements or to the lower chords, said fastening points being located at different distances from an end of the roadway element;

wherein the roadway element, the lower chords and the diagonal elements have constant lengths.

2. A bridge according to claim 1, wherein the lower chords are at least twice as long as the diagonal elements.

3. A bridge according to claim 2, wherein the roadway element has trapezoidal and have a bottom side adapted to receive the diagonal elements and the lower chords.

4. A bridge according to claim 3, wherein the roadway elements have rails on each end and several different fastening possibilities for said second ends of the diagonal elements.

5. A bridge according to claim 4, wherein two outermost fastening points at opposite ends of the roadway element are separated from one another by the length of one of said lower chords.

6. A bridge according to claim 1, wherein the roadway element is trapezoidal and has a bottom side adapted to receive the diagonal elements and the lower chords.

7. A bridge according to claim 1, wherein the roadway element has rails on each end and several different fastening possibilities for said second ends of the diagonal elements.

8. A bridge according to claim 1, wherein two outermost fastening points at opposite ends of the roadway element are separated from one another by the length of one of said lower chords.

9. A bridge module comprising:

a roadway element having a plurality of fastening points, said fastening points being located at different distances from an end of the roadway element;

lower chords having ends and a constant length, each lower chord being shorter than the roadway element; and diagonal elements with first and second ends and a constant length, with the first end of each diagonal element fastened to one of the ends of one of the lower chords;

wherein the lower chords and the second ends of the diagonal elements are selectively fastenable to different said fastening points such that the height of a framework of each bridge module formed by the roadway element, the lower chords, and the diagonal elements is adjustable.

* * * * *